US005248181A

United States Patent [19]

Efthimiou

[11] Patent Number: 5,248,181

[45] Date of Patent: Sep. 28, 1993

[54] CRADLE FOR INFANT CAR SEAT

[76] Inventor: Peter S. Efthimiou, 1912 White Rose La., Carrollton, Tex. 75007

[21] Appl. No.: 932,667

[22] Filed: Aug. 20, 1992

Related U.S. Application Data

[63] Continuation-in-part of Ser. No. 903,821, Jun. 23, 1992.

[51] Int. Cl.[5] ..... A47C 13/00

[52] U.S. Cl. ..... 297/130; 297/452.13; 297/256.16

[58] Field of Search ..... 297/130, 232, 250, 253, 297/257, 281, 280, 457, 485, 464, 351, 441

[56] References Cited

U.S. PATENT DOCUMENTS

| | | | |
|---|---|---|---|
| 3,972,559 | 8/1976 | Anacher | 297/441 X |
| 3,985,460 | 10/1976 | Piper et al. | 297/457 X |
| 4,510,634 | 4/1985 | Diedrich et al. | 297/441 X |
| 4,638,995 | 1/1987 | Wilson | 297/457 X |

FOREIGN PATENT DOCUMENTS

| | | | |
|---|---|---|---|
| 2617214 | 11/1977 | Fed. Rep. of Germany | 297/250 |
| 2920586 | 11/1980 | Fed. Rep. of Germany | 297/130 |

*Primary Examiner*—Laurie K. Cranmer
*Attorney, Agent, or Firm*—Timmons & Kelly

[57] ABSTRACT

A cradle for an infant carrier formed of spaced apart upright side frames and adapted along their undersurface for placement on a floor or other suitable flat surface. Securing the side frames together at a lower level are a plurality of parallel slats transversely extending between the side frames whereas a pair of transverse bars at the front and rear of the side frame secure the side frames at a relatively upper level. Secured at opposite ends to the front and rear bars for extending between the side frames in a generally longitudinal direction is a slack length of canvas disposed in a generally catenary formation therebetween. The front and rear bars along with the underlying length of canvas define a cradle support for a carrier placed thereon while strap means extending laterally from each of the side frames can be buckled together for securing the carrier and infant in place.

5 Claims, 2 Drawing Sheets

CRADLE FOR INFANT CAR SEAT

This application is a continuation-in-part of design application Ser. No. 07/903,821 filed Jun. 23, 1992.

FIELD OF THE INVENTION

The field of art to which the invention relates comprises the art of chair-like structures in which to support an infant carrier safely secured therein.

BACKGROUND OF THE INVENTION

The use of carriers for transporting infants in a vehicle are widespread and are even mandated by the laws of many states. On arriving at the destination, the infant typically is carried in the carrier from the vehicle to wherever, the attending adult proceeds by foot whether it be a residence, restaurant, or other commercial establishment. Other than when removing the infant from the carrier for placement elsewhere, the carrier frequently functions as a placement carrier for the infant by setting it with the infant on the floor, table, or other suitable surface at the site location within sight of the adult. Such setting arrangements can quickly prove unsatisfactory where the infant in the carrier is for example, set on the floor in a distant pedestrian traffic pattern such as may occur in a restaurant. Likewise, placing the carrier and infant on the lap of the adult or on the table in a restaurant situation can prove equally unsatisfactory for obvious reasons. While most establishments provide highchairs and elevated seats for the older child, a similar accommodation is not generally available for the carrier seated infant.

Despite recognition of the foregoing, a ready solution has not heretofore been known.

OBJECTS OF THE INVENTION

It is an object of the invention to provide a novel device by which to support an infant carrier containing an infant at a site location removed from a vehicle.

It is a further object of the invention to effect the foregoing object in a cradle structure able to support the carrier with infant in an elevated chair-like manner.

It is a still further object of the invention to provide a novel support device as in the previous objects that is relatively inexpensive to manufacture and can be conveniently stored on site at various business establishments, such as restaurants, that are commonly patronized by persons carrying an infant carrier with infant.

SUMMARY OF THE INVENTION

This invention relates to a cradle for infant carriers. More specifically, the invention relates to an upright cradle structure for non-automobile on-floor placement able to provide cradle support for an infant carrier in a normally horizontal orientation. By the cradle being available at the contemplated site where the need occurs, it becomes unnecessary to place the infant and carrier on the floor or on a table space exposed to the dangers of the environment. Having such a designated support receptacle in which to place the infant carrier, not only serves to protect the infant but places the infant within convenient reach and sight of the attending adult.

To effect the foregoing, the cradle hereof comprises an upright chair-like structure having four legs for non-automobile on-floor placement. Centrally extending front to back from crossbars joining a pair of side frames, is a slack length of fabric, such as canvas defining a seat that cooperates with the bars to closely support an infant carrier received therein. The side frames are dimensionally spaced apart so as to snugly receive the standard width infant carrier intervening therebetween whereby the bars, side frames and fabric seat cooperate to provide a snug, vibration free and secure support for a received carrier. Strap elements oppositely secured to the side frames to overlay a received carrier can be joined to provide an added element of safety against infant moving or inadvertent jarring of the carrier within the cradle. The cradle, like the highchair which is normally kept on site at many commercial establishments for the older infant able at least to maintain a sitting posture, will provide a similar accommodation for the infant.

The above noted features of the invention as well as other superior aspects thereof will be further appreciated by those skilled in the art upon reading the detailed description that follows in conjunction with the drawings.

DESCRIPTION OF THE PREFERRED EMBODIMENT

Figure 1:
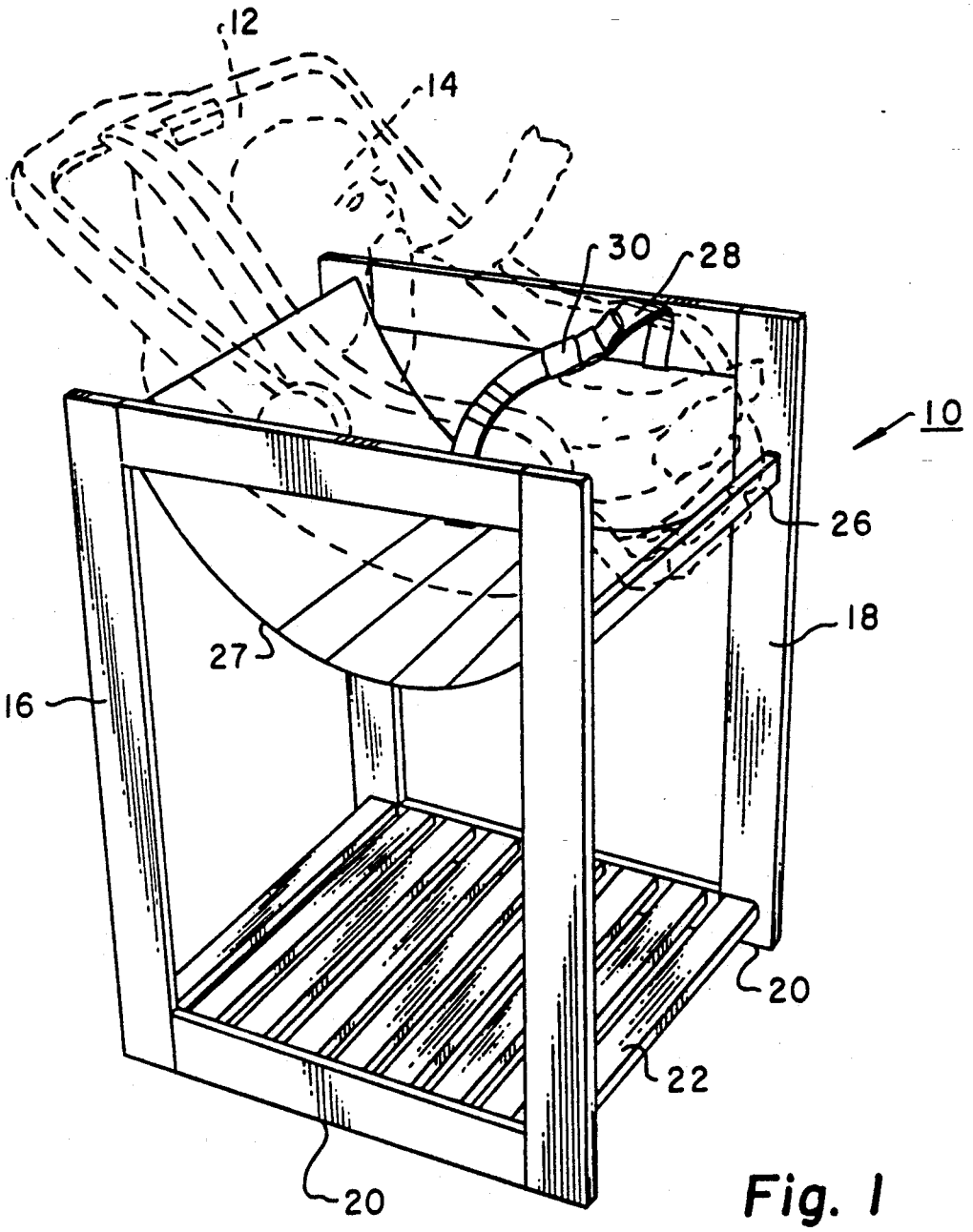
FIG. 1 is a front left perspective view of the cradle of the invention.
Figure 5:
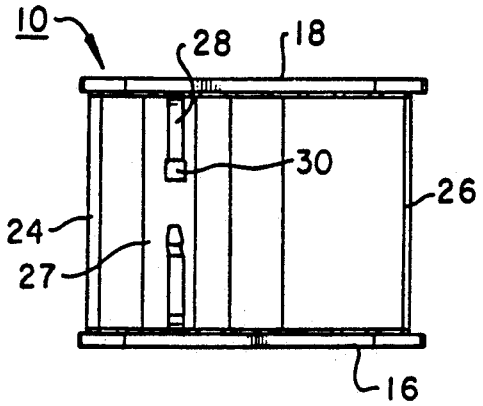
FIG. 5 is a top plan view thereof.
Figure 2:
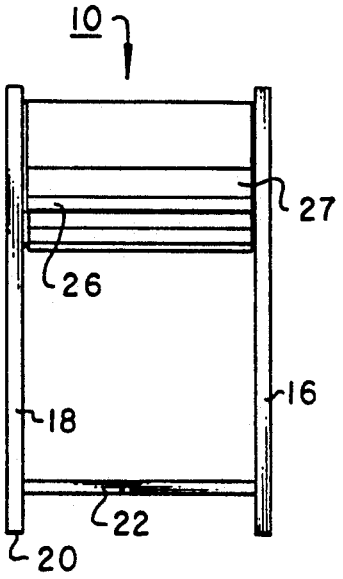
FIG. 2 is a front elevational view thereof.
Figure 3:
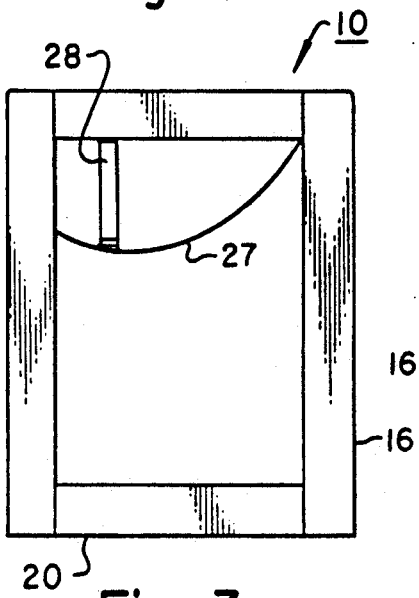
FIG. 3 is a right side elevational view thereof.
Figure 4:
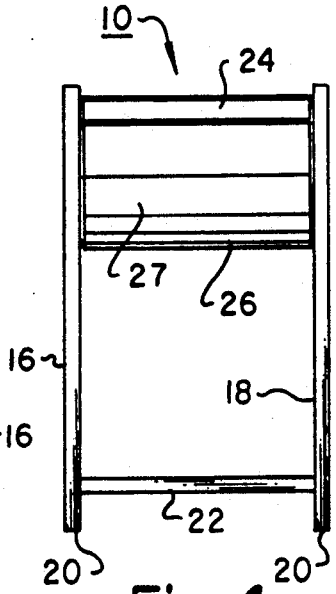
FIG. 4 is a rear elevational view thereof.
Figure 6:
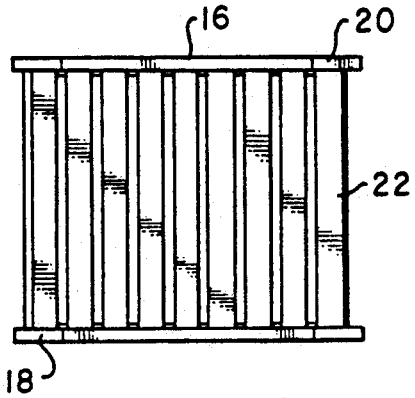
FIG. 6 is a bottom plan view thereof.

In the description which follows, like parts are marked throughout the specification and drawings with the same reference numerals respectively. The drawing figures are not necessarily to scale and in certain views, parts may have been exaggerated for purposes of clarity.

Referring now to the drawings, the cradle hereof is designated 10 and is adapted to accommodate an infant carrier 12 containing an infant 14 both shown in phantom.

Comprising the cradle 10 is a pair of rectangular, spaced apart side frames 16 and 18 which along their underedge 20 are suitable for setting on a floor or other suitably flat surface. Joining the side frames together at a lower level are a plurality of transverse parallel slats 22 which when secured together in the manner illustrated afford the cradle 10 a chair-like posture.

Securing the side frames together at a relatively upper level is a rear transverse bar 24 and a front transverse bar 26. The spacing between the side frames, as defined by the slats and bars is dimensionally sized so as to enable convenient placement and retrieval of a standard width infant carrier 12 (usually about 15 inches). Side clearance between the carrier and side frames is minimal so as to avoid the possibility of any disturbing sideway displacement of the carrier when positioned in the cradle.

Attached to bars 24 and 26 is a length of fabric 27, such as heavyweight cotton canvas that is installed in a slack relation so as to form an intervening, more or less catenary seating surface, for the underside of the received carrier 12. For forming the catenary, it will be noted that the rear bar 24 is slightly elevated above the front bar 26. In this manner a carrier 12, when placed between the side frames, will enable the rear of the car seat to rest on bar 24 and the front of the carrier to rest on bar 26 while the central portion is generally protected by underlying fabric seat 27. When so set, the cradle affords an infant in the carrier a substantially normal horizontal orientation. To then secure the infant and carrier in position, there is provided opposite straps 28 and a center buckle 30 affording adjustment of the straps while enabling the carrier and infant to be tautly secured to the cradle.

By the above description there is disclosed a novel cradle structure for readily accommodating support of an infant carrier on site. Since the cradle can be readily stored in the manner of a highchair, it can be conveniently retrieved from a storage location at such time as it is needed. Being that the cradle will support a carrier in a convenient and comfortable manner the contained infant is removed from the jeopardy of placement on a limited choice area of a floor or table surface. Having the option of placement, the cradle can be conveniently set within the watchful eye of the attending adult who can be more readily alerted to the needs of the infant as they occur. By means of the cradle hereof, there is fulfilled a long felt need to satisfy a basic requirement of the current American lifestyle. In this manner, the infant can be transported, carried and placed in a preferred location without the necessity of removal from the carrier.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A cradle for an infant carrier comprising:

first means defining a pair of upright generally rectangular sides that along their underside are adapted for relatively flat surface placement, said upright sides being arranged parallel in a dimensionally controlled spaced-apart relation to closely accommodate receipt of an infant carrier intervening therebetween with an upper portion of said sides extending generally horizontal at a level affording interference to prevent significant side movement of a carrier received between said sides;

second means transversely extending between said sides for securing such sides together in said dimensionally controlled spaced-apart relation; said second means being at a lower elevation thereof for affording placement stability to the sides;

a transverse rear bar securing said sides together at a relatively upper elevation thereof;

a transverse front bar securing said sides together at a relatively upper elevation thereof but at a height relatively lower than said rear bar;

a length of flexible composition having a width substantially the width of the spacing between said sides and extending in a generally slack relation between said rear bar and said front bar to underlie an infant carrier received between said sides in a generally spaced relation from the underside of the carrier means for releasably securing the infant carrier within the cradle.

2. A cradle in accordance with claim 1 in which the relative height of said rear and front bars is selected to provide rear and front support respectively for an infant carrier placed thereon while maintaining a desired horizontal orientation of the received carrier.

3. A cradle in accordance with claim 2 wherein the means for releasably securing the infant carrier comprises safety straps oppositely extending from the respective of said sides so as to transversely overlie an infant carrier placed therein and a buckle means associated with said straps for securing the loose ends of said straps tautly against a carrier placed therein.

4. A cradle in accordance with claim 3 in which said flexible composition comprises a fabric disposed in a catenary form for underlying an infant carrier placed therein.

5. A cradle in accordance with claim 4 in which said second means comprises a plurality of parallel slats individually secured to the respective of said sides.

* * * * *